US008910752B2

(12) United States Patent
Furutani

(10) Patent No.: US 8,910,752 B2
(45) Date of Patent: Dec. 16, 2014

(54) ELEVATOR SYSTEM

(75) Inventor: Yukihiro Furutani, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 566 days.

(21) Appl. No.: 13/379,382

(22) PCT Filed: Sep. 2, 2009

(86) PCT No.: PCT/JP2009/065324

§ 371 (c)(1),
(2), (4) Date: Dec. 20, 2011

(87) PCT Pub. No.: WO2011/027429

PCT Pub. Date: Mar. 10, 2011

(65) Prior Publication Data

US 2012/0138389 A1 Jun. 7, 2012

(51) Int. Cl.

| | |
|---|---|
| ***B66B 1/20*** | (2006.01) |
| ***B66B 1/46*** | (2006.01) |
| ***B66B 3/00*** | (2006.01) |

(52) U.S. Cl.

CPC ..... *B66B 1/468* (2013.01); *B66B 2201/4653* (2013.01); *B66B 3/006* (2013.01); *B66B 2201/4676* (2013.01)

USPC ..... 187/384; 187/392; 187/396; 187/391

(58) Field of Classification Search

CPC ..... B66B 2201/212; B66B 2201/40; B66B 2201/4607; B66B 2201/4615; B66B 2201/4638; B66B 2201/4653; B66B 2201/4669; B66B 2201/4676

USPC ..... 187/247, 380–388, 391–393, 396

See application file for complete search history.

(56) References Cited

U.S. PATENT DOCUMENTS

| | | | | |
|---|---|---|---|---|
| 7,190,256 | B2 * | 3/2007 | Pieper | 340/5.7 |
| 7,328,775 | B2 * | 2/2008 | Zaharia et al. | 187/396 |

(Continued)

FOREIGN PATENT DOCUMENTS

| | | |
|---|---|---|
| CN | 1898140 A | 1/2007 |
| JP | 2 127377 | 5/1990 |

(Continued)

OTHER PUBLICATIONS

Combined Office Action and Search Report issued Aug. 21, 2013 in Chinese Application No. 200980160417.1 (With English Translation).

(Continued)

*Primary Examiner* — Anthony Salata

(74) *Attorney, Agent, or Firm* — Oblon, Spivak, McClelland, Maier & Neustadt, L.L.P.

(57) ABSTRACT

An elevator system in which plural elevator banks are present in a building, and a security gate through which a user should pass is defined for each bank, appropriate guidance can be given to the user without reducing the elevator operating efficiency. The elevator system includes a notifying device for notifying the user who passes through the security gate of information; an identifying mechanism determining, based on the identification information inputted from an inputting device when the user passes through the security gate, whether or not the user is a pre-registered person; and a determining mechanism determining whether or not the security gate through which the user, who is determined to be a pre-registered person by the identifying mechanism, passes is a normal gate for the user. If the result of determination is Yes, elevator call registration is made, and if the result of determination is No, the notifying device notifies the user of information for guiding the user to the normal gate with no elevator call registration being made.

4 Claims, 6 Drawing Sheets

(56) References Cited

U.S. PATENT DOCUMENTS

| | | | | |
|---|---|---|---|---|
| 7,353,915 | B2 * | 4/2008 | Zaharia et al. | 187/388 |
| 7,581,622 | B2 * | 9/2009 | Amano | 187/384 |
| 7,849,974 | B2 * | 12/2010 | Stanley et al. | 187/387 |
| 8,028,806 | B2 * | 10/2011 | Stanley et al. | 187/387 |
| 8,162,109 | B2 * | 4/2012 | Amano | 187/382 |
| 8,490,754 | B2 * | 7/2013 | Amano | 187/384 |
| 8,573,366 | B2 * | 11/2013 | Elomaa et al. | 187/387 |
| 8,684,142 | B2 * | 4/2014 | Finschi | 187/392 |
| 2009/0020372 | A1 | 1/2009 | Amano | |

FOREIGN PATENT DOCUMENTS

| | | |
|---|---|---|
| JP | 6 87582 | 3/1994 |
| JP | 2001 354365 | 12/2001 |
| JP | 2003 63760 | 3/2003 |
| JP | 3658007 | 6/2005 |
| JP | 2005 256518 | 9/2005 |
| JP | 2007 320758 | 12/2007 |
| KR | 10-2006-0103526 | 10/2006 |
| WO | 2006 043324 | 4/2006 |

OTHER PUBLICATIONS

International Search Report Issued Nov. 24, 2009 in PCT/JP09/65324 Filed Sep. 2, 2009.

Office Action issued Apr. 4, 2014 in Chinese Patent Application No. 200980160417.1 with English language translation (the text of the Office Action only).

Office Action issued Jan. 31, 2013, in Korean Patent Application No. 10-2012-7000987 with English translation.

International Preliminary Report on Patentability and Written Opinion issued Mar. 29, 2012 in PCT/JP2009/065324.

* cited by examiner

ELEVATOR SYSTEM

TECHNICAL FIELD

The present invention relates to an elevator system that makes call registration of an elevator while being interlocked with a security gate of a building.

BACKGROUND ART

In recent years, many buildings have been provided with a security gate at the entrance thereof to prevent crimes in the building and intrusion of suspicious persons into the building. Such buildings have been configured so that there is introduced a system in which by installing a device for identifying individuals at the security gate, the entry into an elevator hall is permitted via identifying operation for the first time.

On the other hand, as the conventional technique of an elevator system in which a gate is provided at the entrance of the elevator hall, the elevator system, for example, described in Patent Literature 1 is available.

In this elevator system, the call registration of elevator is made automatically according to the position of the gate through which a user has passed. Specifically, in this elevator system, a sensor for detecting the user who has passed through the gate is provided at the gate for permitting the user to enter the elevator hall, and when the sensor detects the user, call registration is made according to the position of the sensor.

CITATION LIST

Patent Literature

Patent Literature 1: Japanese Patent No. 3658007

SUMMARY OF INVENTION

Technical Problem

In the elevator system described in Patent Literature 1, if the user makes a mistake in choosing the position of the gate through which the user passes, a call that is unnecessary inherently is registered, which presents problems of reduced elevator operating efficiency and prolonged waiting time of users.

On the other hand, in a relatively large-scale building or the like, in some cases, a plurality of banks in which service floors are defined in a predetermined range are present, and the gate through which the user passes is defined for each bank. In the case where the elevator system described in Patent Literature 1 is used in the above-described building, when the user passes through the gate to a wrong bank, wasteful call registration is made. In addition, if that bank does not include the destination floor of the user as a service floor, the user may be perplexed because he/she does not find the bank to be used inherently.

Even in the case where a security gate is provided at the entrance of elevator hall, if the security gate through which the user passes is defined for each bank, the same problem as described above occurs.

The present invention has been made to solve the above-described problems, and an object of the invention is to provide an elevator system in which a plurality of elevator banks are present in a building, and a security gate through which a user should pass is defined for each bank, the elevator system being configured so that even when the user has passed through the gate to a wrong bank, appropriate guidance can be given to the user without reducing the elevator operating efficiency.

Solution to Problem

An elevator system of the present invention is an elevator system in which a plurality of elevator banks are provided in a building, and a user passes through a security gate defined for each bank to enter an elevator hall of each bank. The elevator system comprises a notifying device for notifying the user who passes through the security gate of predetermined information, an inputting device for inputting identification information when the user passes through the security gate, storage means for storing the identification information and the destination floor information of the user so as to be related to each other, identifying means for determining, based on the identification information inputted from the inputting device and the identification information stored in the storage means, whether or not the user who inputs the identification information from the inputting device is a pre-registered person, determination means for determining, based on the information on the security gate at which the user inputs the identification information when passing through it and the information stored in the storage means, whether or not the security gate through which the user, who is determined to be a pre-registered person by the identifying means, passes is a normal gate for the entry into the hall of the bank in which the user's destination floor is included in the service floors thereof; and operation control means for making elevator call registration if it is determined by the determination means that the security gate through which the user passes is the normal gate, and causes the notifying device to notify the user of information for guiding the user to the normal gate without making the elevator call registration if it is determined that the security gate through which the user passes is not the normal gate.

Advantageous Effect of Invention

According to the present invention, in an elevator system in which a plurality of elevator banks are present in a building, and a security gate through which a user should pass is defined for each bank, even when the user has passed through the gate to a wrong bank, appropriate guidance can be given to the user without reducing the elevator operating efficiency.

DESCRIPTION OF EMBODIMENTS

The present invention will be described in more detail with reference to the accompanying drawings. Incidentally, in each of the drawings, like numerals refer to like or similar parts and redundant descriptions of these parts are appropriately simplified or omitted.

First Embodiment

Figure 1:
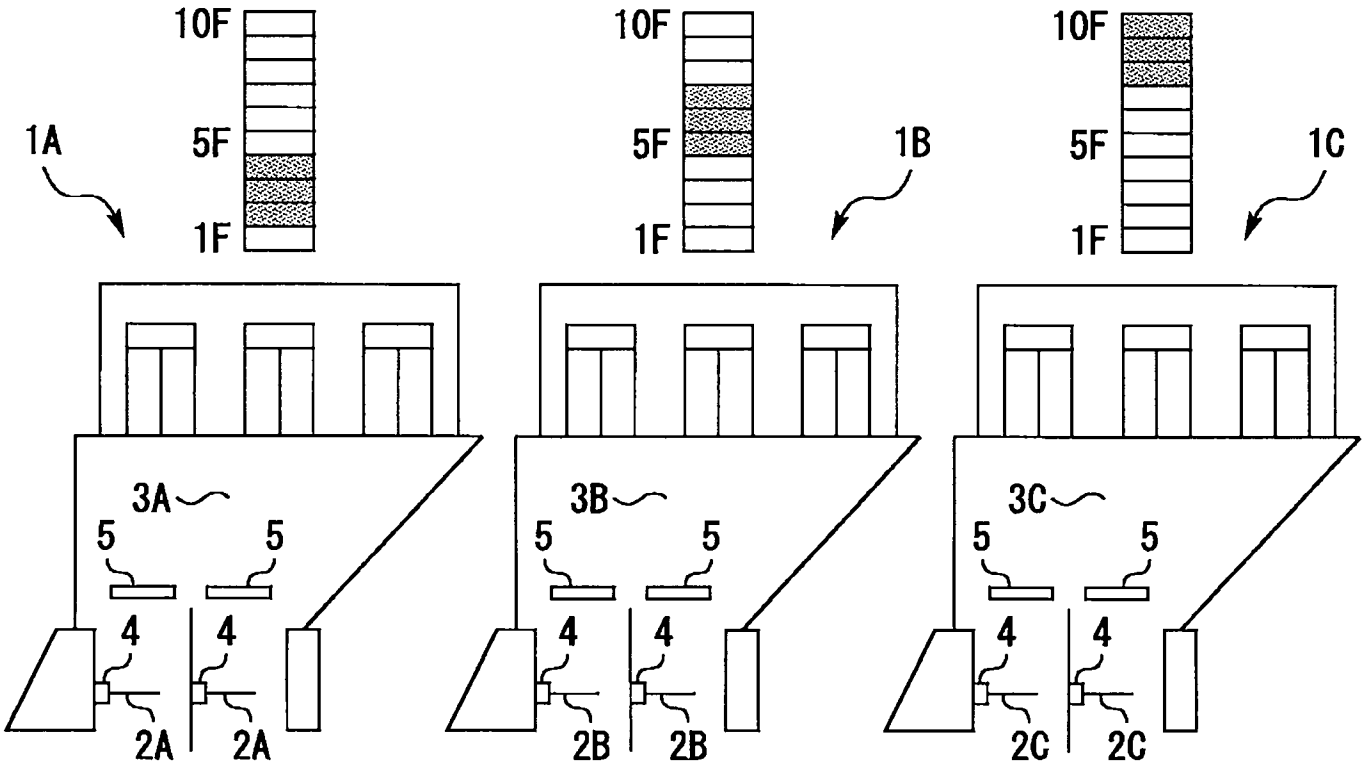
FIG. 1 is a schematic view showing a general configuration of an elevator system in a first embodiment according to the present invention.
Figure 2:
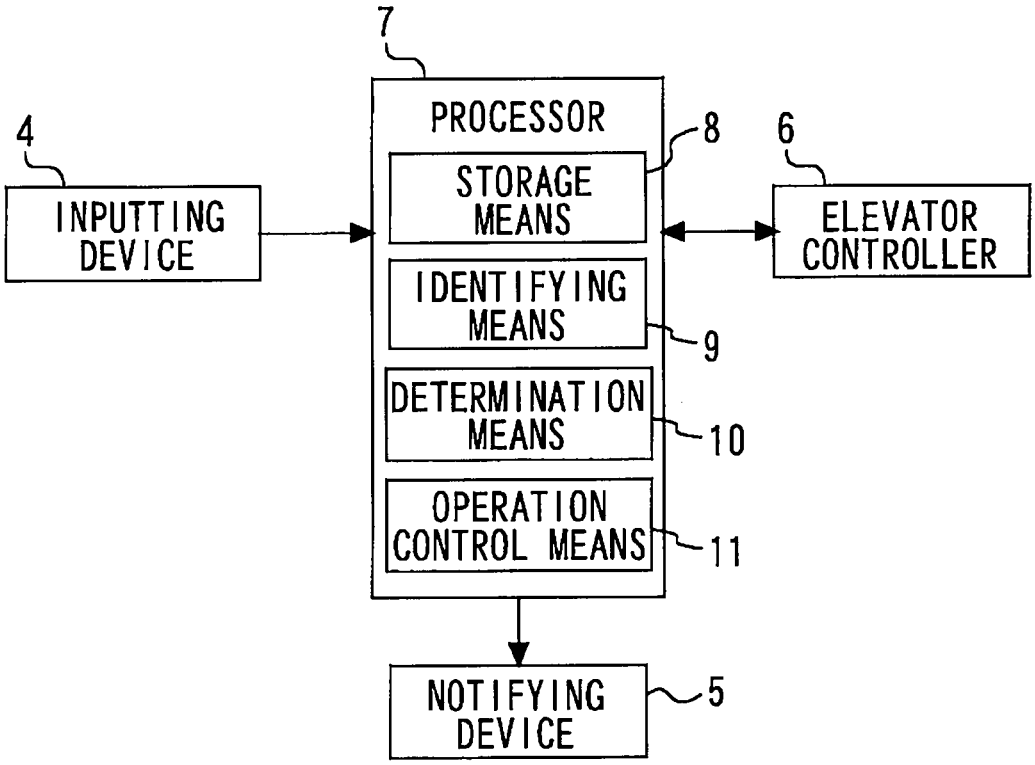
FIG. 2 is a block diagram of the elevator system in the first embodiment according to the present invention.

FIG. 1 is a schematic view showing a general configuration of an elevator system in a first embodiment according to the present invention, and FIG. 2 is a block diagram of the elevator system in the first embodiment according to the present invention.

The elevator system in accordance with this embodiment has a plurality of elevator banks (hereinafter, also referred simply to as "banks") in a building. Specifically, in FIG. 1, reference signs 1A to 1C denote elevator banks. The elevator bank 1A is provided with a plurality of elevators operated for low stories of the building, and the service floors thereof (the floors at which an elevator car stops) are preset to the 1st floor and 2nd to 4th floors. Also, the elevator bank 1B is provided with a plurality of elevators operated for middle stories of the building, and the service floors thereof are preset to the 1st floor and 5th to 7th floors. The elevator bank 1C is provided with a plurality of elevators operated for high stories of the building, and the service floors thereof are preset to the 1st floor and 8th to 10th floors.

Hereinafter, in the case where the banks 1A to 1C need not be especially distinguished, each of the banks is also written as bank 1. Also, the above-described service floors of the banks 1 are merely examples, and the service floors of the banks 1 may overlap partially or wholly. For example, in the case where the building is a 30-storied high-rise building, the service floors of the bank 1A may be preset to the 1st floor and 2nd to 15th floors, the service floors of the bank 1B may be preset to the 1st floor and 10th to 25th floors, and the service floors of the bank 1C may be preset to the 1st floor and 20th to 30th floors.

Also, the elevator system of this embodiment is configured so that unless the user passes through a security gate defined for each bank 1, the user cannot enter an elevator hall (hereinafter, also referred simply to as a "hall") of the bank 1.

Specifically, reference sign 2A denotes a security gate for the entry into an elevator hall 3A of the bank 1A, 2B denotes a security gate for the entry into an elevator hall 3B of the bank 1B, and 2C denotes a security gate for the entry into an elevator hall 3C of the bank 1C. Hereinafter, in the case where the security gates 2A to 2C and the halls 3A to 3C need not be especially distinguished, each of the security gates and halls is also written as security gate 2 and hall 3, respectively.

Reference sign 4 denotes an inputting device for the user who wants to use an elevator to input the identification information of the user himself/herself when the user passes through the security gate 2. This inputting device 4 is installed at each of the security gates 2. When the identification information is inputted into the inputting device 4 by the user, the inputting device 4 outputs the information of the corresponding security gate 2 together with the read identification information. The inputting device 4 consists of a noncontact card reader, a device for reading biometric information (identification information) such as fingerprint, or the like.

Reference sign 5 denotes a notifying device for notifying the user passing through the security gate 2 of predetermined information. This notifying device 5 is installed so as to correspond to each of the security gate 2, and is configured so as to be able to give information to each of the users passing through the security gate 2. The notifying device 5 consists of an indicator for accomplishing letter display, pattern display, map display, or the like, an announcing device for making voice announcement, or the like.

Reference sign 6 denotes a controller for carrying out elevator operation control, and reference sign 7 denotes a processor forming the essential portion of this system. The processor 7 has functions of performing processing variously based on the information inputted from the inputting device 4, the controller 6, and the like and controlling the operations of the security gate 2, the notifying device 5, and the like. Specifically, to perform the functions, the processor 7 includes a storage means 8, an identifying means 9, a determination means 10, and an operation control means 11.

The storage means 8 has a function of storing, in advance, information necessary for the operation of this system. This storage means 8 stores the identification information of a predetermined user and the destination floor information of the user in relation to each other. Also, the storage means 8 stores information concerning each of the bank 1 (bank information) such as the service floors, information concerning the each of security gate 2 (gate information) such as information for determining which security gate 2 should to be used for the entry into the hall 3 of any bank 1, and the like information.

The identifying means 9 has a function of determining, based on the identification information inputted from the inputting device 4 and the identification information stored in the storage means 8, whether or not the user whose identification information is inputted from the inputting device 4 (person to be identified) is a person pre-registered as a person permitted to use the elevator (pre-registered person). This identifying means 9 determines that the person to be identified is the pre-registered person, for example, when information coinciding with the identification information inputted from the inputting device 4 is present in the identification information stored in advance in the storage means 8.

The determination means 10 has a function of making various determinations necessary in this system. For example, when the user is identified with a pre-registered person by the identifying means 9, the determination means 10 determines, based on the information of the security gate 2 into which the user has inputted the identification information when passing through it and various pieces of information stored in the storage means 8, whether or not the security gate 2 through which the user has passed is the normal gate for the user. The normal gate means a security gate 2 for the entry into the hall 3 of the bank 1 including the user's destination floor as a service floor.

For example, in the case where the destination floor of the user, who is a pre-registered person, is the 3rd floor and has been stored in advance in the storage means 8, when the user passes through the security gate 2A, the determination means 10 determines that the security gate 2A is the normal gate. On the other hand, when the user passes through the security gate 2B or 2C, since the service floors of the banks 1B and 1C do not include the 3rd floor, the determination means 10 determines that either of the security gates 2B and 2C is not the normal gate.

The operation control means 11 has a function of controlling various operations necessary in this system based on the determination results etc. of the identifying means 9 and the determination means 10. Specifically, the operation control means 11 has a call registration requesting function for requesting the controller 6 to make call registration of elevator, a notification control function for causing the notifying device 5 to notify the user of predetermined information, and a gate opening/closing control function for opening and closing the security gate 2.

For example, when it is determined by the determination means 10 that the security gate 2 through which the user has passed is the normal gate, the operation control means 11 sends an elevator No. call to the controller 6, and makes call registration of elevator. On the other hand, when it is determined by the determination means 10 that the security gate 2 through which the user has passed is not the normal gate, the operation control means 11 does not send the elevator No. call to the controller 6, that is, does not make call registration of elevator, and causes the notifying device 5 to notify the user of the information for guiding the user to the normal gate.

Figure 3:
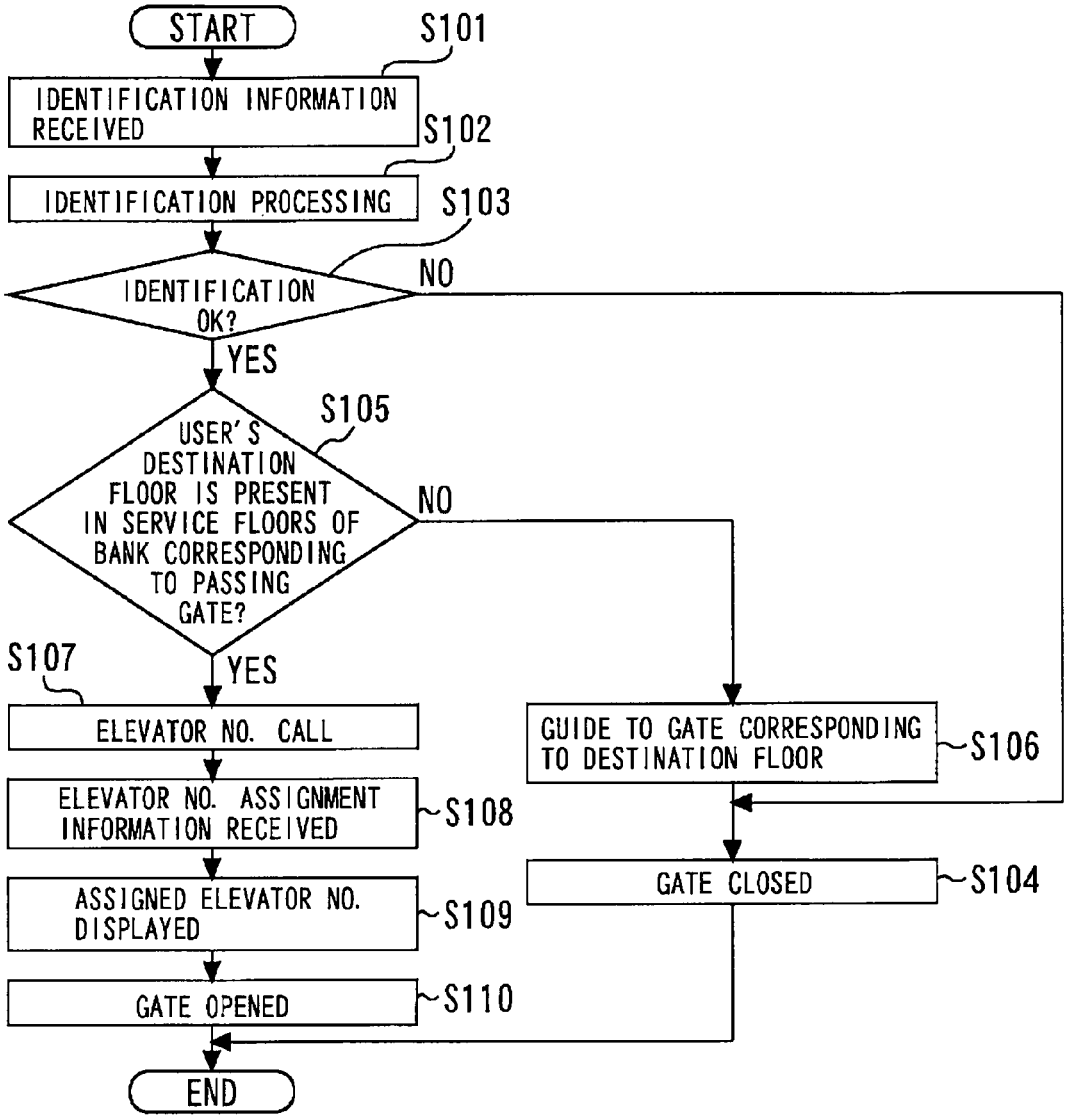
FIG. 3 is a flowchart showing the operation of the elevator system in the first embodiment according to the present invention.
Figure 4:
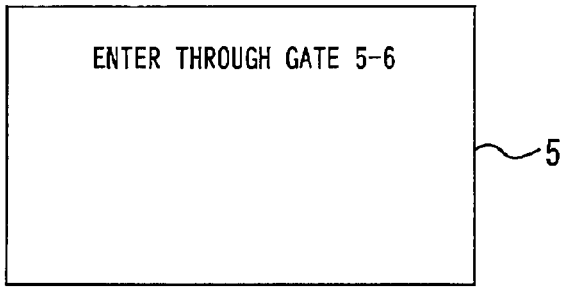
FIG. 4 is a view showing a display example of the indicator.
Figure 5:
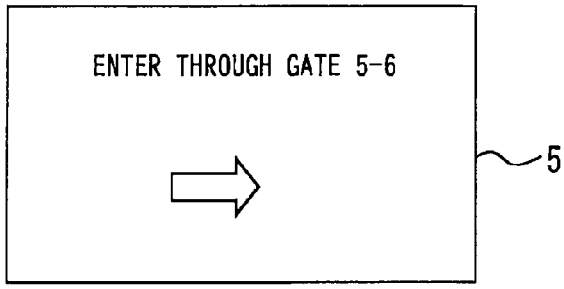
FIG. 5 is a view showing another display example of the indicator.
Figure 6:
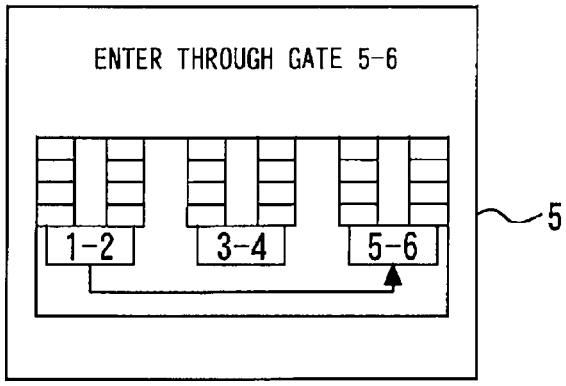
FIG. 6 is a view showing another display example of the indicator.

Next, the operation of the elevator system having the above-described configuration is explained specifically with reference to FIGS. 3 to 6. FIG. 3 is a flowchart showing the operation of the elevator system in the first embodiment according to the present invention, showing the operation flow of the processor 7. Also, FIG. 4 is a view showing a display example of the indicator, and FIGS. 5 and 6 are views showing other display examples of the indicator. Hereinafter, explanation is given of the case where the indicator such as a liquid crystal display is provided as the notifying device 5.

When a certain user inputs identification information from the inputting device 4 to pass through the security gate 2, the inputting device 4 outputs the read identification information and the information of the security gate 2 through which the user is going to pass to the processor 7. Upon receipt of the above-described items of information from the inputting device 4 (S101), the processor 7 first causes the identifying means 9 to perform identification processing of the identification information inputted into the inputting device 4 and the identification information stored in advance in the storage means 8, and determines whether or not the user is a pre-registered person (S102, S103).

If the determination result is No in the identification processing (that is, it is determined in the identification processing of S102 that the user is not a pre-registered person), the operation control means 11 closes the security gate 2 corresponding to the inputting device 4 to which the user has inputted the identification information, whereby the user is inhibited from passing through the security gate 2 to enter the hall 3 (S104).

On the other hand, if the determination result is Yes in the identification processing (that is, it is determined in the identification processing of S102 that the user is a pre-registered person), the processor 7 next determines, by using the determination means 10, whether or not the security gate 2 through which the user is going to pass is the normal gate for the user (S105).

Specifically, the determination means 10 first determines the destination floor of this user by referring to the destination floor information stored in the storage means 8 in relation to the identification information of the user. Also, the determination means 10 determines the service floors of the bank 1 corresponding to the security gate 2 through which the user is going to pass from the information of the security gate 2 sent from the inputting device 4 together with the identification information of this user. Then, by comparing the determined user's destination floor with the service floors of the bank 1, the determination means 10 determines that the user is going to pass through the normal gate in the case where the user's destination floor is included in the determined service floors of the bank 1 (Yes in S105).

If it is determined that the user's destination floor is not included in the determined service floors of the bank 1, and the security gate 2 through which the user is going to pass is not the normal gate for the user (No in S105), the operation control means 11 displays predetermined information on the indicator to guide the user to the normal gate (S106). In the case where announcing device is provided as the notifying device 5 together with the indicator, announcement for guiding the user to the normal gate is also made.

Specifically, if it is determined in S105 that the security gate 2 through which the user is going to pass is not the normal gate for the user, the operation control means 11, based on various pieces of information stored in the storage means 8, determines the bank 1 in which the user's destination floor is included in the service floors, and determines the security gate 2 for the entry into the hall 3 of that bank 1, that is, the normal gate for the user. Then, the operation control means 11 causes the indicator, which corresponds to the security gate 2 through which the user is going to pass, to display the information on the determined normal gate, the information on the way to the normal gate, and the like information, thereby guiding the user to the security gate 2 through which the user should pass inherently.

FIGS. 4 to 6 show display examples of the indicator in S106. FIG. 4 shows an example in which the indicator accomplishes only a letter display to show (the name of) the normal gate. Also, FIG. 5 shows an example in which the indicator accomplishes a pattern (arrow mark) display in addition to the letter display to show the normal gate and the direction to the normal gate. FIG. 6 shows an example in which the indicator further accomplishes a map display in the building to show the normal gate and the way to go from the user's present position.

On the other hand, if it is determined by the determination means 10 in S105 that the security gate 2 through which the user is going to pass is the normal gate for the user, in the processor 7, the operation control means 11 performs processing for carry the user to his/her destination floor.

Specifically, the operation control means 11 first sends an elevator No. call based on the user's destination floor (elevator assignment request) to the controller 6 (S107). Then, in the controller 6, the assignment to the elevator No. call is determined. On receipt of that information (elevator No. assignment information)(S108), the operation control means 11 causes the indicator, which corresponds to the security gate 2 through which the user is going to pass, to display the assigned elevator No. (S109), thereby notifying the user of the elevator in which the user should use. Also, the operation control means 11 opens the security gate 2 through which the user is going to pass, and permits the user to enter the hall 3 (S110). The opening operation of the security gate 2 in S110 may be performed in parallel with the operation in S107.

According to the first embodiment of the present invention, when the user is going to pass through the gate 2 to a wrong bank 1, the user can be guided appropriately to the gate 2 through which the user should pass inherently, so that the convenience can be improved. Also, wasteful call registration is not made in such a case, the reduction in elevator operation efficiency and the prolongation of waiting time of other users can be prevented.

Second Embodiment

In a second embodiment, explanation is given of the case where the storage means 8 stores a plurality of pieces of destination floor information in relation to the user's identification information. That is, the user causes the storage means 8 to store a plurality of floors in advance as his/her own destination floors.

In such a case, if it is determined in the identification processing of S102 in FIG. 3 that the user is a pre-registered person, the processor 7 determines, by using the determination means 10, whether or not the security gate 2 through which the user is going to pass is the normal gate for the user (S105).

Specifically, the determination means 10 determines all of the destination floors of the user by referring to the destination floor information stored in the storage means 8. Also, the determination means 10 determines the service floors of the bank 1 corresponding to the security gate 2 through which the user is going to pass. Then, by comparing the determined user's destination floors with the service floors of the bank 1, the determination means 10 determines that the user is going to pass through the normal gate in the case where any of the user's destination floors is included in the determined service floors of the bank 1 (Yes in S105).

If it is determined that all of the determined user's destination floors are not included in the determined service floors of the bank 1, and the security gate 2 through which the user is going to pass does not correspond to any of the normal gates for the user, the process proceeds to S106, in which processing for guiding the user to the normal gate is performed without making elevator call registration.

Specifically, if it is determined in S105 that the security gate 2 through which the user is going to pass does not correspond to any of the normal gates for the user, the operation control means 11, based on the predetermined conditions, selects one destination floor from among the user's destination floors, and gives notification for guiding the user to the normal gate corresponding to that destination floor. As the destination floor selected to determine the normal gate, a preset floor such as the uppermost floor or the lowermost floor may be selected. Alternatively, the destination floor information is stored in the storage means 8 together with the priority, and the destination floor may be selected for each user on the basis of the priority.

On the other hand, if it is determined by the determination means 10 in S105 that the security gate 2 through which the user is going to pass corresponds to any of the normal gates for the user, the determination means 10 next determines whether or not the user's destination floors are included in the determined service floors of the bank 1. If only one destination floor of the user is included in the service floors, the operation control means 11 performs processing in S107 and the subsequent steps based on that destination floor. On the other hand, if a plurality of user's destination floors are included in the service floors, based on the predetermined conditions, the operation control means 11 selects one destination floor from among the user's destination floors, and performs processing in S107 and the subsequent steps based on the selected destination floor. A preset floor such as the uppermost floor or the lowermost floor may be selected as the destination floor. Alternatively, the destination floor information is stored in the storage means 8 together with the priority, and the destination floor may be selected for each user on the basis of the priority.

If the elevator system is configured as described above, even in the case where the user who has set a plurality of floors as his/her own destination floors is going to pass through the gate 2 to a wrong bank 1, appropriate guidance can be given to the user without reducing the elevator operating efficiency.

Other configurations and functions are the same as those of the first embodiment.

Third Embodiment

The operation of an elevator system in accordance with a third embodiment is explained with reference to FIG. 7.

Figure 7:
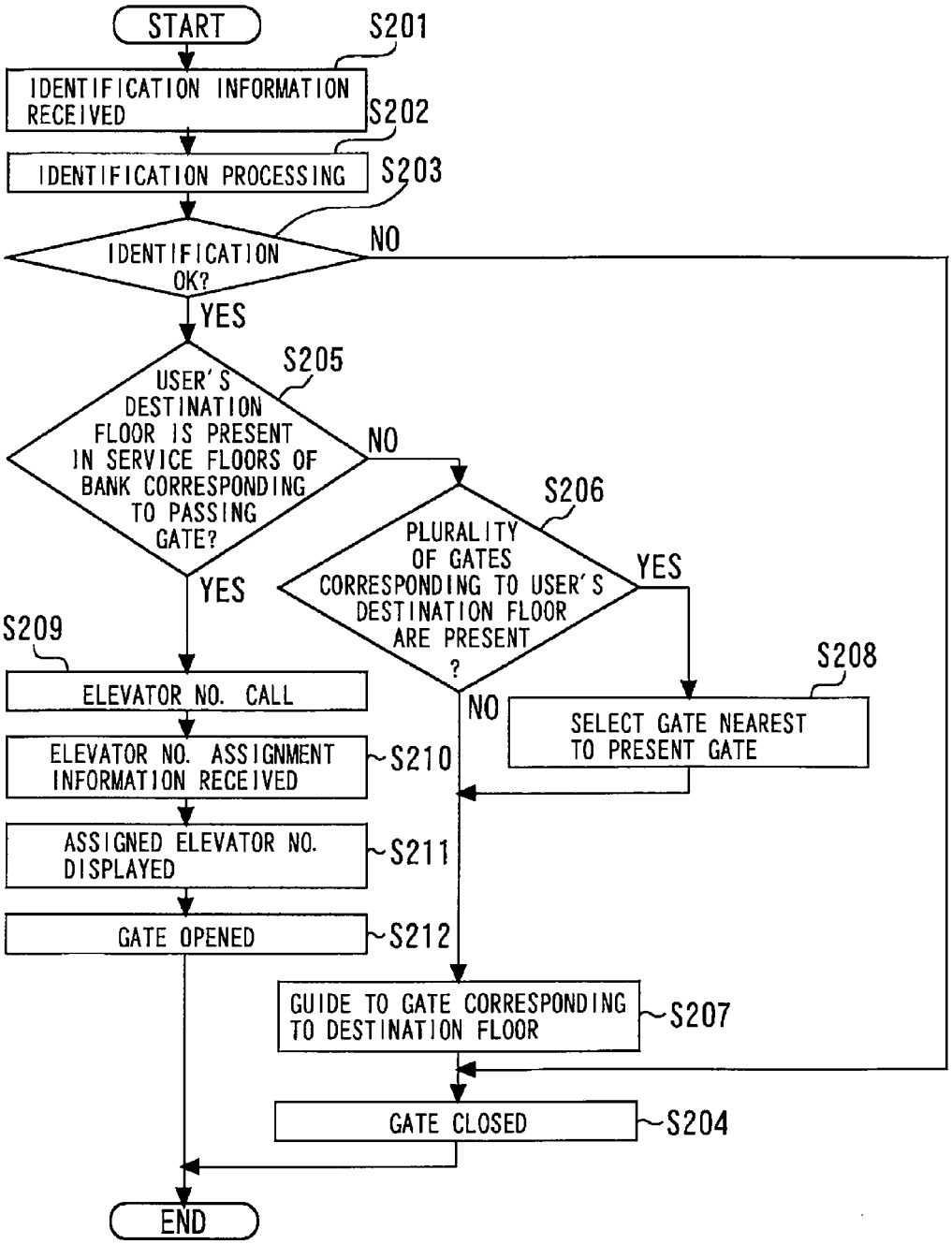
FIG. 7 is a flowchart showing the operation of the elevator system in a third embodiment according to the present invention.

FIG. 7 is a flowchart showing the operation of the elevator system in the third embodiment according to the present invention. In FIG. 7, the operation in S201 through S205 is the same as the operation in S101 through S105 in FIG. 3, and the operation in S209 through S212 is the same as the operation in S107 through S110 in FIG. 3. Therefore, the specific explanation of the operation in these steps is omitted.

If the destination floor of the user who is going to pass through the security gate 2 is not included in the service floors of the corresponding bank 1, and it is determined in S205 that the security gate 2 concerned is not the normal gate for the user, the determination means 10 determines whether or not the user's destination floors are included in the service floors of a plurality of banks 1, that is, a plurality of normal gates for the user are present (S206). If only one normal gate for the user is present, the operation control means 11 causes the corresponding notifying device 5 to notify the user of the information for guiding the user to that normal gate (S207).

On the other hand, if it is determined in S206 that the plurality of normal gates for the user are present, the determination means 10 next determines the normal gate that is present at the position nearest to the user's present position (S208). Specifically, based on the gate information stored in the storage means 8, the determination means 10 calculates a distance between the security gate 2 through which the user is going to pass at present and each of the security gates 2 that are the user's normal gates, and selects the normal gate for which that distance is the shortest. Then, the operation control means 11 causes the notifying device 5 corresponding to the security gate 2 through which the user is going to pass to notify the user of the information on the normal gate selected in S208, the information on the way to go to that normal gate, and the like, thereby guiding the user to the selected normal gate.

If the elevator system is configured as described above, in the case where the user is going to pass through the gate 2 to a wrong bank 1, the user can be notified of a route having the shortest distance, so that the convenience can be improved further.

Other configurations and functions are the same as those of the first or second embodiment.

Fourth Embodiment

The operation of an elevator system in accordance with a fourth embodiment is explained with reference to FIG. 8.

Figure 8:
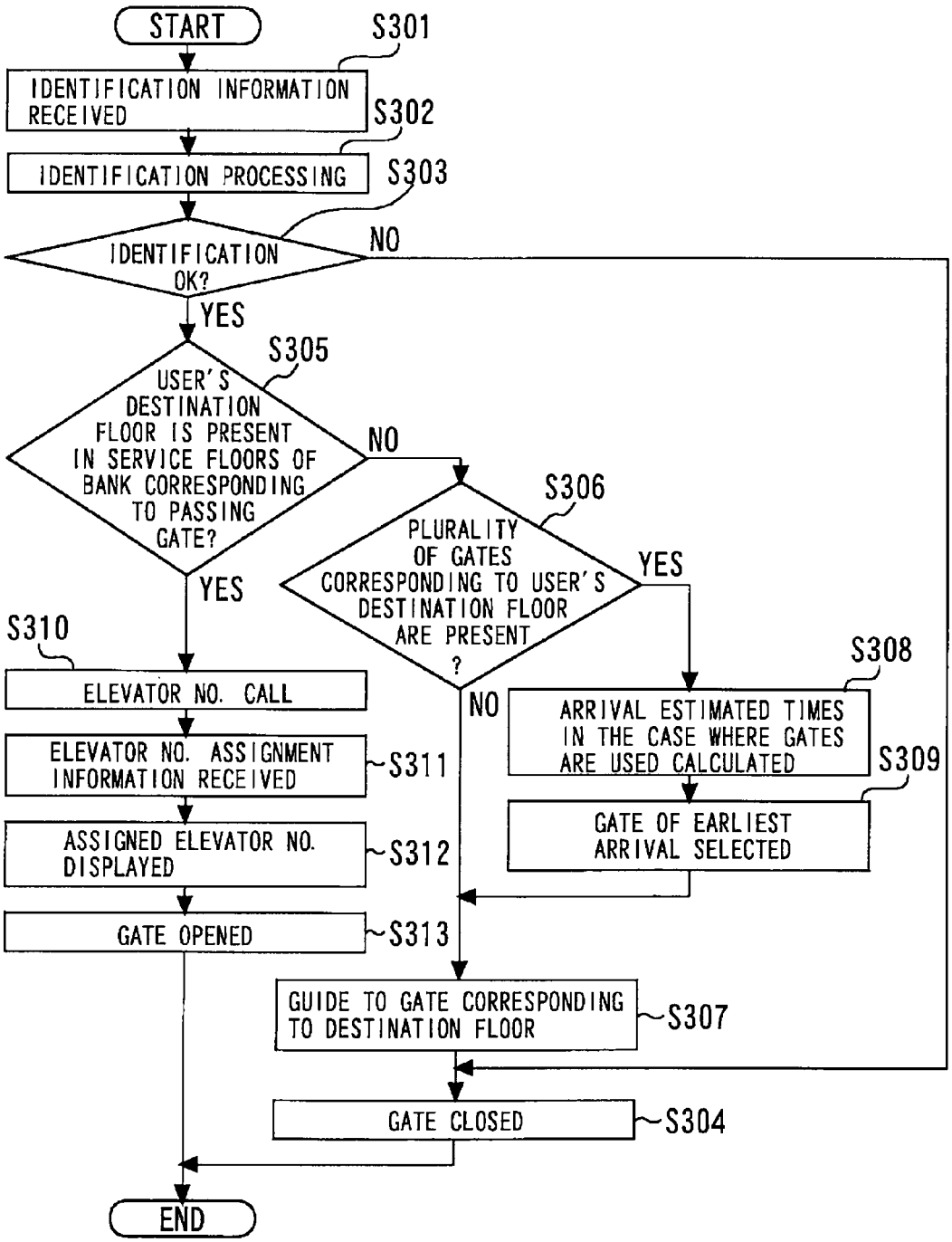
FIG. 8 is a flowchart showing the operation of the elevator system in a fourth embodiment according to the present invention.

FIG. 8 is a flowchart showing the operation of the elevator system in the fourth embodiment according to the present invention. In FIG. 8, the operation in S301 through S305 is the same as the operation in S101 through S105 in FIG. 3, and the operation in S310 through S313 is the same as the operation in S107 through S110 in FIG. 3. Therefore, the specific explanation of the operation in these steps is omitted.

If the destination floor of the user who is going to pass the security gate 2 is not included in the service floors of the corresponding bank 1, and it is determined in S305 that that security gate 2 is not the normal gate for the user, the determination means 10 determines whether or not the user's destination floors are included in the service floors of a plurality of banks 1, that is, whether or not a plurality of normal gates for the user are present (S306). If only one normal gate for the user is present, the operation control means 11 causes the corresponding notifying device 5 to notify the user of the information for guiding the user to that normal gate (S307).

On the other hand, if it is determined in S306 that the plurality of normal gates for the user are present, the determination means 10 next calculates estimated times taken for the user to arrive at each of his/her target floors when using the normal gates, and determines the normal gate used for a route by which the arrival at the target floor (destination floor) is made the earliest (S308, S309).

Specifically, based on the gate information stored in the storage means 8, the determination means 10 calculates times (transfer times) necessary for transfer between the security gates 2 from the distances between the security gate 2 through which the user is going to pass at present and each of the security gates 2 that are the user's normal gates. Also, by taking in the operation states of each of the bank 1, assuming that the call registration is made to each of the bank 1, the determination means 10 calculates times (operation times) necessary for the elevators to carry the user to the target floor in response to the call. Then, from the calculated transfer times and operation times, the determination means 10 determines the route by which the time taken for arrival at the target floor is the shortest, and selects the normal gate used by this route.

The operation control means 11 causes the notifying device 5 corresponding to the security gate 2 through which the user is going to pass to notify the user of the information on the normal gate selected in S309, the information on the way to go to the selected normal gate, and the like information, thereby guiding the user to the selected normal gate.

If the elevator system is configured as described above, in the case where the user is going to the gate 2 to a wrong bank 1, the user can be guided to the shortest time route, so that the convenience can be improved further.

Other configurations and functions are the same as those of the first or second embodiment.

INDUSTRIAL APPLICABILITY

The elevator system according to the present invention can be applied to the case where a plurality of elevator banks are present in a building, and a security gate through which a user should pass is defined for each bank.

REFERENCE SIGNS LIST

1A, 1B, 1C elevator bank
2A, 2B, 2C security gate
3A, 3B, 3C elevator hall
4 inputting device
5 notifying device
6 controller
7 processor
8 storage means
9 identifying means
10 determination means
11 operation control means

The invention claimed is:

1. An elevator system in which a plurality of elevator banks are provided in a building, and a user passes through a security gate defined for each bank to enter an elevator hall of each bank, comprising:

a notifying device for notifying the user who passes through the security gate of predetermined information;

an inputting device for inputting identification information when the user passes through the security gate;

a storage device for storing the identification information and the destination floor information of the user so as to be related to each other;

an identifying device for determining, based on the identification information inputted from the inputting device and the identification information stored in the storage device, whether or not the user who inputs the identification information from the inputting device is a pre-registered person;

a determination device for determining, based on the information on the security gate at which the user inputs the identification information when passing through it and the information stored in the storage device, whether or not the security gate through which the user, who is determined to be a pre-registered person by the identifying device, passes is a normal gate for the entry into the hall of the bank in which the user's destination floor is included in the service floors thereof; and an operation control device for making elevator call registration if it is determined by the determination device that the security gate through which the user passes is the normal gate, and causes the notifying device to notify the user of information for guiding the user to the normal gate without making the elevator call registration if it is determined that the security gate through which the user passes is not the normal gate, wherein in the case that the security gate through which the user passes is not the normal gate, and the user's destination floor is included in the service floors of a plurality of banks, the operation control device guides the user to the normal gate which is present at a position nearest to the user's present position.

2. The elevator system according to claim 1, wherein the notifying device includes an indicator; and the operation control device guides the user to the normal gate by at least any display of a letter display, pattern display, and map display on the indicator.

3. An elevator system in which a plurality of elevator banks are provided in a building, and a user passes through a security gate defined for each bank to enter an elevator hall of each bank, comprising:

a notifying device for notifying the user who passes through the security gate of predetermined information;

an inputting device for inputting identification information when the user passes through the security gate;

a storage device for storing the identification information and the destination floor information of the user so as to be related to each other;

an identifying device for determining, based on the identification information inputted from the inputting device and the identification information stored in the storage device, whether or not the user who inputs the identification information from the inputting device is a pre-registered person;

a determination device for determining, based on the information on the security gate at which the user inputs the identification information when passing through it and the information stored in the storage device, whether or not the security gate through which the user, who is determined to be a pre-registered person by the identifying device, passes is a normal gate for the entry into the hall of the bank in which the user's destination floor is included in the service floors thereof; and an operation control device for making elevator call registration if it is determined by the determination device that the security gate through which the user passes is the normal gate, and causes the notifying device to notify the user of information for guiding the user to the normal gate without making the elevator call registration if it is determined that the security gate through which the user passes is not the normal gate, wherein in the case that the security gate through which the user passes is not the normal gate, and the user's destination floor is included in the service floors of a plurality of banks, the operation control device guides the user to the normal gate by which arrival at the destination floor is made earliest.

4. The elevator system according to claim 3, wherein the notifying device includes an indicator; and the operation control device guides the user to the normal gate by at least any display of a letter display, pattern display, and map display on the indicator.

* * * * *